United States Patent [19]

Walkhoff

[11] Patent Number: 4,570,364

[45] Date of Patent: Feb. 18, 1986

[54] ARTICLE OF ATHLETIC FOOTWEAR, ESPECIALLY A SKI BOOT

[75] Inventor: Klaus Walkhoff, Kreuzlingen, Switzerland

[73] Assignee: Raichle Sportschuh AG, Kreuzlingen, Switzerland

[21] Appl. No.: 581,067

[22] Filed: Feb. 17, 1984

[30] Foreign Application Priority Data

Feb. 23, 1983 [CH] Switzerland ..... 999/83

[51] Int. Cl.[4] ..... A43B 5/04

[52] U.S. Cl. ..... 36/121

[58] Field of Search ..... 36/117–121

[56] References Cited

U.S. PATENT DOCUMENTS

| | | | |
|---|---|---|---|
| 3,713,231 | 1/1973 | Mochizuki | 36/121 |
| 3,718,995 | 3/1973 | Graup | 36/121 |
| 3,735,508 | 5/1973 | Gertsch et al. | 36/121 |
| 4,199,879 | 4/1980 | Wegeng | 36/121 |
| 4,476,640 | 10/1984 | Aldinio et al. | 36/121 |

FOREIGN PATENT DOCUMENTS

| | | | |
|---|---|---|---|
| 0053339 | 6/1982 | European Pat. Off. . | |
| 2322286 | 11/1973 | Fed. Rep. of Germany | 36/121 |

*Primary Examiner*—James Kee Chi

*Attorney, Agent, or Firm*—Werner W. Kleeman

[57] ABSTRACT

Two adjusting mechanisms are arranged between a lower shaft portion having a sole and a shin portion covering the shin region of the leg of a wearer and forwardly and rearwardly pivotable about a transverse axis in relation to the lower shaft portion. Each adjusting mechanism is constructed in the manner of a turnbuckle and comprises two threaded rods having opposite-handed threads. One threaded rod is anchored on the shin portion while the other threaded rod is hingedly mounted on the lower shaft portion. The threaded rods can be displaced toward one another or away from one another by means of a rotatable housing permitting a variation of the distance between the engagement points of the adjusting mechanisms. In this manner, the position or attitude of the shin portion in relation to the lower shaft portion can be adjusted both backward and forward as well as to the side. A compression spring is arranged in the interior of the housing and which is compressed under the action of a forward pivoting motion of the shin portion.

22 Claims, 3 Drawing Figures

ARTICLE OF ATHLETIC FOOTWEAR, ESPECIALLY A SKI BOOT

BACKGROUND OF THE INVENTION

The present invention broadly relates to an article of athletic footwear and, more specifically, pertains to a new and improved construction of a ski boot.

Generally speaking, the ski boot of the present invention comprises a lower shaft portion having a sole and a transverse axis, a shin portion mounted to pivot about the transverse axis relative to the lower shaft portion for covering the shin region of the leg of the wearer or user of the ski boot and forming an upper shaft portion of the ski boot, and adjustment or adjusting means for adjusting the attitude of the shin portion relative to the lower shaft portion.

A ski boot of this type is known from the German Patent Publication No. 2,322,286, published Nov. 29, 1973 in which the upper shaft portion, which can be fastened to the lower shaft portion to pivot about a transverse axis, is adjustable toward the side in relation to the lower shaft portion. For this purpose, a U-shaped holder or retention element is mounted at the lower shaft portion and is rotatable about an axis extending substantially perpendicular to the sole of the ski boot. Pivot pins mounted on the interior of the upper shaft portion and determining the pivot axis engage apertures on the legs of the this U-shaped holder or retention element. By rotating the retention element the position of the pivot axis of the upper shaft portion can be varied. In this way it is possible to bring the position of this pivot axis into alignment with the axis of the ankle of the foot of the wearer of the ski boot. This obtains the effect that the upper shaft portion can readily follow the shin or lower leg of the wearer in a forward motion.

In addition to and independent of this arrangement for adjusting the pivot axis on the upper shaft portion, an adjusting device for varying the orientation angle of the upper shaft portion in relation to the lower shaft portion is arranged between the front side of the upper shaft portion and the top side of the lower shaft portion. This adjustment device corresponds in design and function to the arrangement described in the German Patent Publication No. 2,128,769 and the corresponding U.S. Pat. No. 3,713,231, granted Jan. 30, 1973.

This known ski boot has the disadvantage that it requires two separate arrangements for the adjustment of the position of the upper shaft portion in relation to the lower shaft portion, which leads to a complicated design subject to malfunction. Furthermore, putting the shoe on and taking it off is quite inconvenient, as is the adjustment of the pivot axis of the upper shaft portion.

It is known from Swiss Pat. No. 531,147 and the corresponding U.S. Pat. No. 3,718,995 granted Mar. 6, 1973 to provide a springing arrangement on each side of the ski boot which comprises a compression spring arranged in the lower shaft portion and upon which a rod hingedly mounted on the upper shaft portion is supported. These two springing arrangements serve to accommodate shocks in the forward direction but do not permit an adjustment of the neutral or unloaded position of the upper shaft portion in relation to the lower shaft portion.

SUMMARY OF THE INVENTION

Therefore, with the foregoing in mind, it is a primary object of the present invention to provide a new and improved construction of a ski boot which does not have associated with it the aforementioned drawbacks and shortcomings of the prior art constructions.

Another and more specific object of the present invention aims at providing a new and improved construction of a ski boot of the previously mentioned type which is of simple design and can be put on and taken off without great difficulty and wherein the position of the upper shaft portion in relation to the lower shaft portion can be varied without great difficulty and with few operations even when the ski boot is on the foot of the wearer.

Yet a further significant object of the present invention aims at providing a new and improved construction of a ski boot of the character described which is relatively simple in construction and design, extremely economical to manufacture, highly reliable in operation, not readily subject to breakdown or malfunction and requires a minimum of maintenance and servicing.

Now in order to implement these and still further objects of the present invention, which will become more readily apparent as the description proceeds, the ski boot of the present invention is manifested by the features that it comprises adjustment means including at least two mutually independently operable adjusting or adjustment mechanisms each having two free ends. A respective one of the two free ends of each of the two adjusting mechanisms operatively engage the lower shaft portion of the ski boot at a respective engagement point, and a respective other one of the two free ends of the two adjusting mechanisms operatively engage the shin portion of the ski boot at another respective engagement point, and the mutual positional interrelation of each of the respective engagement points at the lower shaft portion and at the shin portion is variable and adjustable.

The mutual positional relationships of the engagement points of the adjusting mechanisms can be varied independently of one another by means of the two adjustment mechanisms located on the upper surface of the shoe. This permits both the pivoting or angular attitude or orientation of the upper shaft portion and its position in relation to the lower shaft portion to be simultaneously adjusted toward the side or laterally. The lateral adjustment of the upper shaft portion permits an adaptation to the anatomy of the leg and especially the lower leg or shin of the wearer. The adjusting mechanisms are preferably so constructed that the distance between their engagement points is variable, for instance by means of a length adjusting mechanism, which is advantageously constructed in the manner of a threaded adjustment mechanism or turnbuckle.

Each adjustment or adjusting mechanism is preferably provided with a damping or spring device which is elastically deformable under the action of a forward motion of the shin portion of the ski boot. In this preferred embodiment, the adjusting mechanism can, in addition to providing adjustment for the upper shaft portion, also fulfill the further object of supplying a resistance to a forward motion of the lower leg or shin of the wearer of the ski boot, i.e. to provide increasing resistance as the degree of forward motion increases, and also to accommodate shocks in the longitudinal direction of the shoe.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
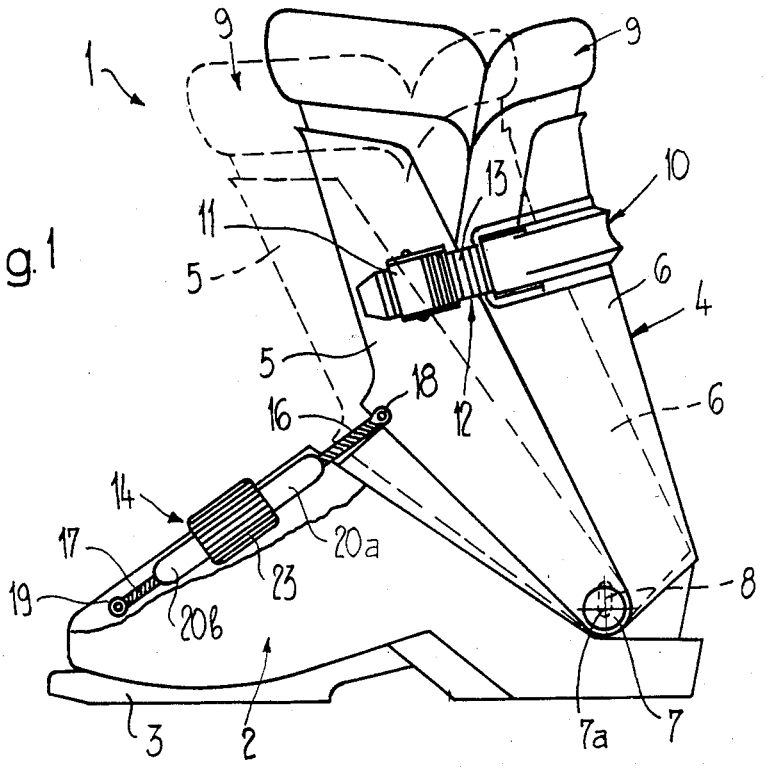
FIG. 1 shows a schematic side view of the ski boot.

Describing now the drawings it is to be understood that to simplify the showing of the drawings only enough of the structure of the ski boot has been illustrated therein as is required to enable one skilled in the art to readily understand the underlying principles and concepts of this invention. The illustrated exemplary embodiment of the ski boot 1 will be seen to comprise a lower shaft portion 2 formed as a relatively stiff shell surrounding the foot and having a sole member 3 as well as an upper shaft portion 4 hingedly connected to the lower shaft portion 2. This upper shaft portion 4 consists of a shin portion 5 covering the lower leg region of a wearer or user and a heel portion 6 engaging the heel and calf region of the leg of the wearer. Both the shin portion 5 and the heel portion 6 are hingedly connected to the lower shaft portion 2 by means of pivot pins 7 at both sides of the lower shaft portion 2. The pivot axis *7a* of the shin portion 5 and the heel portion 6 is determined by the two pivot pins 7. The shin portion 5 and the heel portion 6 can be, however, pivoted independently of one another about the pivot axis *7a*. As shown in FIG. 1 in broken lines, a longitudinal slot 8 can be provided at least on the inner side of the lower shaft portion 2 to permit an adjustment of the pivot axis *7a* in the vertical direction. In the interior of the outer shell formed by the lower shaft portion 2 and the upper shaft portion 4 a soft, upholstered inner shoe 9 is arranged in known manner.

The heel portion 6 can be connected to the shin portion 5 by means of a latch or closure device 10 of known construction. This latch or closure device 10 comprises two buckle or retention elements 11, 11' mounted on the shin portion 5 in mutually opposing relationship with respect to the longitudinal plane of the shoe. A connecting strap 12 or the like fastened to the heel portion 6 engages each of these buckles or retention elements 11, 11'. The connection straps 12 are provided with toothed engagement means 13, 13' at their free ends. The buckles or retention elements 11, 11' retain the connection straps 12, 12' by a detent or ratchet action. This connection between the shin portion 5 and the heel portion 6 permits the shin portion 5 and the heel portion 6 to jointly follow the motion of the user's leg. When the latch or closure device 10 is open, the heel portion 6 can be pivoted towards the rear to facilitate the act of putting on or taking off the ski boot 1.

Figure 2:
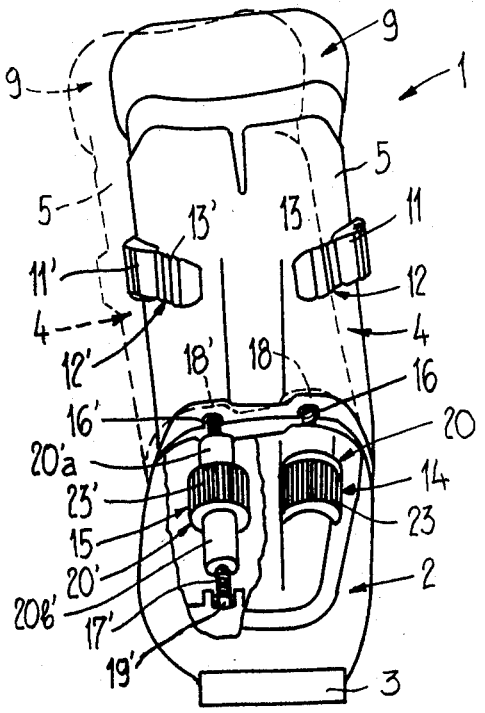
FIG. 2 shows a schematic front view of the ski boot with its two adjustment mechanisms or devices.

Two adjustment or adjusting mechanisms 14 and 15 arranged on both sides of the central longitudinal plane of the shoe in mutually parallel relationship act between the lower shaft portion 2 and the upper shaft portion 4. These two adjusting mechanisms 14 and 15 extend partly within the lower shaft portion 2 and the shin portion 5. In FIGS. 1 and 2, portions of the lower shaft portion 2 have been broken out to render the adjusting mechanisms 14 and 15 visible. The construction of the two identical adjusting or adjustment mechanisms 14 and 15 can best be seen in FIG. 3.

Each of the adjusting mechanisms 14 and 15 comprises two threaded rods 16, 17 and 16', 17', respectively. Each threaded rod 16, 17 is provided with an external thread *16a, 17a*. The threads *16a, 17a* are of opposite hand. The threaded rods 16, 16' are hingedly connected to the shin portion 5 at engagement or connection points 18, 18'. The threaded rods 17, 17' are hingedly connected to the lower shaft portion 2 at engagement or connection points 19, 19'. The threaded rods 16, 17 and 16', 17' are connected to one another by means of a rotatable housing 20 and 20', respectively, comprising two housing parts *20a, 20b,* and *20a', 20b'*, respectively. Each housing part *20a, 20a', 20b, 20b'* is provided with an internal thread 21 and 22, respectively, which engages the external thread *16a* and *17a*, respectively, of the associated threaded rod 16, 17 and 16', 17', respectively. Both internal threads 21, 22 are therefore of opposite hand. The housing part *20a, 20a'* is provided with a cylindrical operating portion 23 and 23', respectively, of larger diameter which is ribbed or serrated on its periphery as can be seen in FIGS. 1 and 2. This operating portion or component 23 and 23' is readily accessible and serves to rotate housing 20 and 20', respectively.

Figure 3:
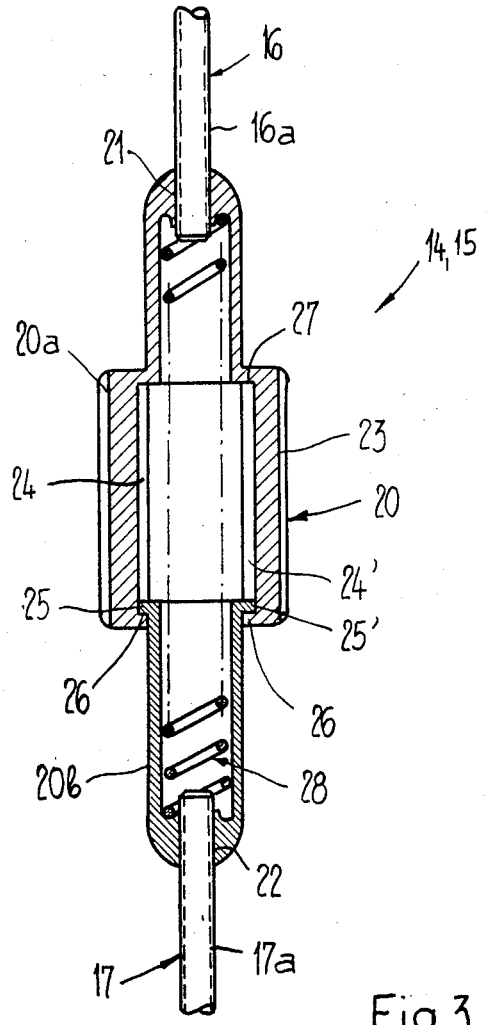
FIG. 3 shows a schematic longitudinal section through one of the adjustment mechanisms or devices on a larger scale than FIGS. 1 and 2.

As can be seen from FIG. 3, the cylindrical, hollow operating portions or components 23 and 23' are provided with longitudinal grooves 24 and 24' on their interior in which knobs or ears 25 and 25' or equivalent structure protruding from the exterior of the housing part *20b* and *20b'* engage. Each operating portion or component 23 and 23' is provided with a flange or edge 26 extending inwardly at its open end to serve as a stop for the protruding ears 25, 25' on the housing part *20b, 20b'*. At the opposite end, the housing part *20a, 20a'* comprises an annular step or shoulder 27 which also serves as a stop for the other housing part *20b, 20b'*. Both housing parts *20a, 20b* and *20a', 20b'*, respectively, are therefore axially displaceable in the longitudinal direction of the housing 20 and 20', respectively, and in the axial direction of the threaded rods 16, 17 and 16', 17', respectively. This relative axial motion is limited by the flange or edge 26 and the step or shoulder 27. Both housing parts *20a, 20b* and *20a', 20b'*, respectively, are, however, fixed against mutual rotation by means of the ears or knobs 25, 25' engaging in the longitudinal grooves 24, 24'.

A spiral spring 28 constructed as a compression or pressure spring is arranged in the interior of each housing 20 and 20', seating on the housing part *20a, 20a'* at one end and on the other housing part *20b, 20b'* at the other end. This spiral spring 28 tends to urge both housing parts *20a, 20b* respectively *20a', 20b'* apart.

As each housing 20 and 20' is turned, the threaded rods 16 and 17 and 16' and 17', respectively, are axially displaced toward one another or away from one another according to the direction of rotation, in the manner of a turnbuckle. By turning the housing 20 and 20', the distance between engagement points 18, 19 and 18', 19' of the adjusting mechanisms 14 and 15, respectively, can therefore be varied. In this manner, the angular orientation of the shin portion 5, and also of the heel portion 6 connected thereto, can be varied in relation to the lower shaft portion 2. Two possible positions of the upper shaft portion 4 are represented in FIG. 1 in solid lines and in broken lines. The two adjusting mechanisms 14 and 15 permit not only a longitudinal pivotal adjustment of the upper shaft portion 4 about the transverse pivot axis *7a*. It is also possible to shift the upper shaft portion 4 in relation to the lower shaft portion 2 in a lateral direction by differential adjustment of the distances between the engagement points 18 and 19 and the engagement points 18' and 19'. This is represented in broken lines in FIG. 2. This position of the upper shaft portion 4 shown in broken lines in FIG. 2 is obtained by adjusting the distance between the engagement points 18', 19' of the adjusting mechanism 15 shorter than the distance between the engagement points 18, 19 of the other adjusting mechanism 14. Due to this differential length adjustment of the two adjusting mechanisms 14 and 15, the shin portion 5 is twisted or torsionally stressed since its lower pivot axis *7a* remains constant. If this pivot axis *7a* is guided in the longitudinal slot 8 as is shown in broken lines in FIG. 1, then this pivot axis *7a* is able to move to a certain degree. It is therefore possible to adapt the shin portion 5 and with it the upper shaft portion 4 to the anatomy of the lower leg of the wearer or user of the ski boot 1 in a relatively simple manner by variously adjusting the adjusting mechanisms 14 and 15 as described above.

If the lower leg of the wearer is moved forward beyond the normal or nominal position of the upper shaft portion 4 predetermined by the adjusting mechanisms 14 and 15 when the ski boot 1 is mounted on the user's or wearer's foot, then the compression springs 28 accommodated in the housings 20, 20' are compressed. These springs 28 therefore provide a resistance to such forward motion of the lower leg which increases with the degree of such forward motion. Furthermore, these spiral springs 28 elastically accommodate or damp shocks acting in the longitudinal direction of the shoe or ski boot 1.

If spiral springs 28 having differing spring characteristics or constants are chosen for each of the adjusting mechanisms 14 and 15, i.e. springs of differing resilience or hardness are chosen, then the effect is obtained that the upper shaft portion 4 moves toward the side or laterally as a consequence of a forward motion. If, for instance, a softer compression spring 28 is used in the adjusting mechanism 14 adjacent to the inner side of the shoe, then the upper shaft portion 4 moves in an outward direction in consequence of a forward motion. The same effect can be obtained by providing a different degree of preload or pre-bias to the compression springs 28 of the two adjusting mechanisms 14, 15. In order to effect such a preloading of the spiral springs 28, the shin portion 5 is pivoted into its rearmost position by rotating the related housing 20, 20'. In this position the shin portion 5 is prevented from pivoting further rearward. If both housings 20, 20' then are both rotated in the same, appropriate direction, the housing parts 20*a*, 20*b* and 20*a'*, 20*b'*, respectively, axially telescopically slide into one another, thereby compressing the related compression spring 28. The degree to which the compression springs 28 are compressed can be individually adjusted for each adjusting mechanism 14, 15.

In addition to the possibilities provided by two independently operatable adjusting or adjustment mechanisms 14, 15 as described above, the provision of two such adjusting mechanisms has the further advantage that it provides increased security, since in the event of a failure or malfunction of one of the adjusting mechanisms, the ski boot 1 is still usable. Furthermore, due to the arrangement of the adjusting mechanisms 14, 15 on both sides of the longitudinal central plane of the ski boot, an undesirable lateral shift of the shin portion 5 in consequence of a forward loading is prevented.

It will be understood that the ski boot described can also be constructed differently in its various parts. In the following paragraphs, some of the various embodiments will be indicated.

As described with reference to FIG. 3, the flange or edge 26 and the step or shoulder 27 of the related housing part 20*a*, 20*a'* serve to limit the relative axial motion between the two housing parts 20*a*, 20*b*, and 20*a'*, 20*b'*. It is possible to arrange damping elements, for instance rubber buffers, which are elastically compressible in both end positions of this relative motion of the housing parts, to act between both housing parts 20*a*, 20*b* and 20*a'*, 20*b'*, respectively, and serving to brake or damp the relative motion between both housing parts in the end regions in order to avoid damage to these housing parts under the influence of relatively great forces.

The adjustment of the lengths between both engagement or connection points 18, 19 and 18', 19' can be effected in other ways than those described. It is, for example, possible to configure only one of the rods 16, 17 and 16', 17', respectively, as a threaded rod upon which an adjusting element analogous to a nut is threaded. This adjusting element must be connected to the other non-threaded rod in a relatively rotatable manner. It is further possible to fix the adjusting element provided with an internal thread against rotation and to permit the adjusting element provided with an external thread to rotate.

Instead of arranging the two engagement or connection points 18, 19 and 18', 19', respectively, on the shin portion 5 and on the lower shaft portion 2 in fixed positions as shown and varying the distance between the engagement points, this distance can be maintained constant and the position of at least one of the engagement or connection points, 18, 19; 18', 19' can be varied. A variation of the positions of the engagement points can, for instance, be obtained by making the engagement point slideable along a straight line, for instance by means of a threaded spindle. It is also possible to provide a series of sequentially arranged fixation points extending in the adjustment direction of the engagement point, any one of which can be selected as the desired engagement point.

Instead of the spiral spring 28 shown, other forms of elastically compressible elements can be provided, for instance gas spring arrangements, in which the compressibility of a gas is exploited for the spring action.

When employing gas spring arrangements, it is also possible to vary the distance between the engagement points 18, 19 and 18', 19', respectively, by modifying the gas pressure in the gas chamber. In air spring arrangements, this pressure change can be effected by means of an air pump which is preferably integrated in the sidewall or wall of the ski boot.

It is also possible to construct the spring arrangements accommodated in the housings 20, 20' such that they are also elastically compressed under the action of a rearward movement of the shin portion 5.

While there are shown and described present preferred embodiments of the invention, it is to be distinctly understood that the invention is not limited thereto, but may be otherwise variously embodied and practiced within the scope of the following claims. Accordingly,

I claim:

1. A ski boot, comprising:

a lower shaft portion having a sole member and a transverse axis;

a shin portion mounted to pivot about said transverse axis relative to said lower shaft portion and intended to cover a shin region of a leg of a wearer of the ski boot and forming an upper shaft portion thereof;

adjustment means for adjusting the attitude of said shin portion relative to the lower shaft portion;

said adjustment means including at least two mutually independently operable adjusting mechanisms each having two ends;

a respective one of said two ends of each of said at least two adjusting mechanisms operatively engaging the lower shaft portion of the ski boot at a respective engagement point;

a respective other one of the two ends of each of the at least two adjusting mechanisms operatively engaging the shin portion of the ski boot at a respective other engagement point; and the mutual positional interrelation of each of said respective engagement points at the lower shaft portion and at the shin portion being variable and adjustable.

2. The ski boot as defined in claim 1, wherein:

the distance between said respective engagement points of each of said two ends of said at least two adjusting mechanisms being variable.

3. The ski boot as defined in claim 1, wherein:

the position of at least one of said respective engagement points of each of said two ends of said at least two adjusting mechanisms being variable.

4. The ski boot as defined in claim 3, wherein:

said at least one respective engagement point being that one thereof located at said lower shaft portion of the ski boot.

5. The ski boot as defined in claim 3, wherein:

said ski boot having a longitudinal direction; and said position being variable in said longitudinal direction.

6. The ski boot as defined in claim 2, wherein:

each of said of least two adjusting mechanisms has a length and includes means for varying said length thereof.

7. The ski boot as defined in claim 6, wherein:

said means for varying said length comprises a threaded, turnbuckle-like, drive mechanism.

8. The ski boot as defined in claim 6, wherein:

said means for varying said length comprises:

at least one first length adjusting means having at least one external thread;

at least one second length adjusting means having at least one internal thread; and said at least one internal thread engaging said at least one external thread.

9. The ski boot as defined in claim 8, wherein:

said at least one second length adjusting means is rotatable.

10. The ski boot as defined in claim 9, wherein:

said at least one second rotatable length adjusting means comprises:

at least two internal threads of opposite handedness:

each of said at least two internal threads engaging a respective one of said at least one external threads of said at least one first length adjusting means; and said at least one external thread being fixed against rotation.

11. The ski boot as defined in claim 3, further including:

a threaded spindle device for varying said position of at least one of said respective engagement points.

12. The ski boot as defined in claim 4, further including:

a threaded spindle device for varying said position of said engagement point at said lower shaft portion.

13. The ski boot as defined in claim 5, further including:

a threaded spindle device for varying said position in said longitudinal direction.

14. The ski boot as defined in claim 5, wherein:

at least two fixation points being arranged in at least one sequential alignment in said longitudinal direction for selectively fixing an associated one of said respective engagement points of said at least two adjusting mechanisms.

15. The ski boot as defined in claim 1, wherein:

said shin portion is capable of a forward motion; and each of said at least two adjusting mechanisms comprising spring means arranged to elastically deform under the action of such forward motion of said shin portion.

16. The ski boot as defined in claim 15, wherein:

said spring means comprises at least one elastically compressible element.

17. The ski boot as defined in claim 16, wherein:

said elastically compressible element is a spiral spring.

18. The ski boot as defined in claim 8, wherein:

said shin portion is capable of a forward motion;

each of said at least two adjusting mechanisms comprising spring means arranged to elastically deform under the action of such forward motion of said shin portion;

said spring means comprises at least one elastically compressible element;

said at least one second length adjusting means comprising two mutually telescopically engaging parts defining a housing formed by said parts;

said elastically compressible element being accommodated in said housing;

at least one of said two parts being provided with internal threads; and said internal threads engaging in said at least one external thread of an associated one of said at least one first adjusting means.

19. The ski boot as described in claim 10, wherein:

said shin portion is capable of a forward motion;

each of said at least two adjusting mechanisms comprising spring means arranged to elastically deform under the action of such forward motion of said shin portion;

said spring means comprises at least one elastically compressible element;

said at least one second length adjusting means comprising two mutually telescopically engaging parts defining a housing formed be said parts;

said elastically compressible element being accommodated in said housing;

each of said two parts being provided with an internal thread;

each said internal thread of each of said parts engaging an associated one of said at least one external thread of said at least one first length adjusting means; and said two parts being mutually fixed against relative rotation.

20. The ski boot as defined in claim 15, wherein:

said spring means comprises a gas spring element.

21. The ski boot as defined in claim 15, wherein:

said spring means of said adjusting mechanisms are individually and differently preloadable.

22. A ski boot as defined in claim 15, wherein:

said shin portion is capable of a rearward motion; and said spring means of each of said adjusting mechanisms being arranged to elastically deform under the action of such rearward motion.

* * * * *

UNITED STATES PATENT AND TRADEMARK OFFICE

CERTIFICATE OF CORRECTION

PATENT NO. : 4,570,364

DATED : February 18, 1986

INVENTOR(S) : KLAUS WALKHOFF

It is certified that error appears in the above—identified patent and that said Letters Patent is hereby corrected as shown below:

Column 7, line 47, (Claim 6) after "said" delete "of" and insert --at--

Signed and Sealed this

Twenty-ninth Day of July 1986

[SEAL]

*Attest:*

DONALD J. QUIGG

*Attesting Officer*

*Commissioner of Patents and Trademarks*